US006158349A

United States Patent [19]

Altenau et al.

[11] Patent Number: 6,158,349

[45] Date of Patent: Dec. 12, 2000

[54] GAS GENERATOR FOR A PROJECTILE

[75] Inventors: Ernst-Wilhelm Altenau, Duisburg; Siegmar Fischer, Celle; Günter Sikorski, Düsseldorf; Ulf Hahn, Unterlüss, all of Germany

[73] Assignee: Rheinmetall W & M GmbH, Unterlüss, Germany

[21] Appl. No.: 09/196,188

[22] Filed: Nov. 20, 1998

[30] Foreign Application Priority Data

Nov. 22, 1997 [DE] Germany ..... 197 51 932

[51] Int. Cl.[7] ..... F42B 13/267

[52] U.S. Cl. ..... 102/490; 102/374; 102/501

[58] Field of Search ..... 102/490, 374, 102/501

[56] References Cited

U.S. PATENT DOCUMENTS

| | | | |
|---|---|---|---|
| 3,628,457 | 12/1971 | Magnusson et al. | 102/490 |
| 3,698,321 | 10/1972 | Wall | 102/490 |
| 3,754,507 | 8/1973 | Dillinger et al. | 102/490 |
| 3,942,443 | 3/1976 | Lyles | 102/490 |
| 3,972,291 | 8/1976 | Braun, Jr. et al. | 102/490 |
| 4,244,294 | 1/1981 | Frignac et al. | 102/490 |
| 4,807,532 | 2/1989 | Andersson et al. | 102/490 |
| 4,846,071 | 7/1989 | Franzen et al. | 102/490 |

*Primary Examiner*—Thomas Price
*Attorney, Agent, or Firm*—Venable; Gabor J. Kelemen

[57] ABSTRACT

A gas generator adapted to be disposed in a rear part of a projectile for increasing the flight range thereof, includes a housing defining a combustion chamber and having a bottom and a longitudinal axis; a fuel accommodated in the combustion chamber; an outlet opening provided in the housing bottom for passage of combustion gases generated in the combustion chamber upon combustion of the fuel; and a plastic fuel-supporting tube extending axially from the outlet opening into the combustion chamber. The plastic material of the fuel-supporting tube is selected such that upon combustion of the fuel aided by a gas pressure of a projectile propellant and by a drag effect, the fuel-supporting tube is deformed and driven out of the outlet opening.

6 Claims, 1 Drawing Sheet

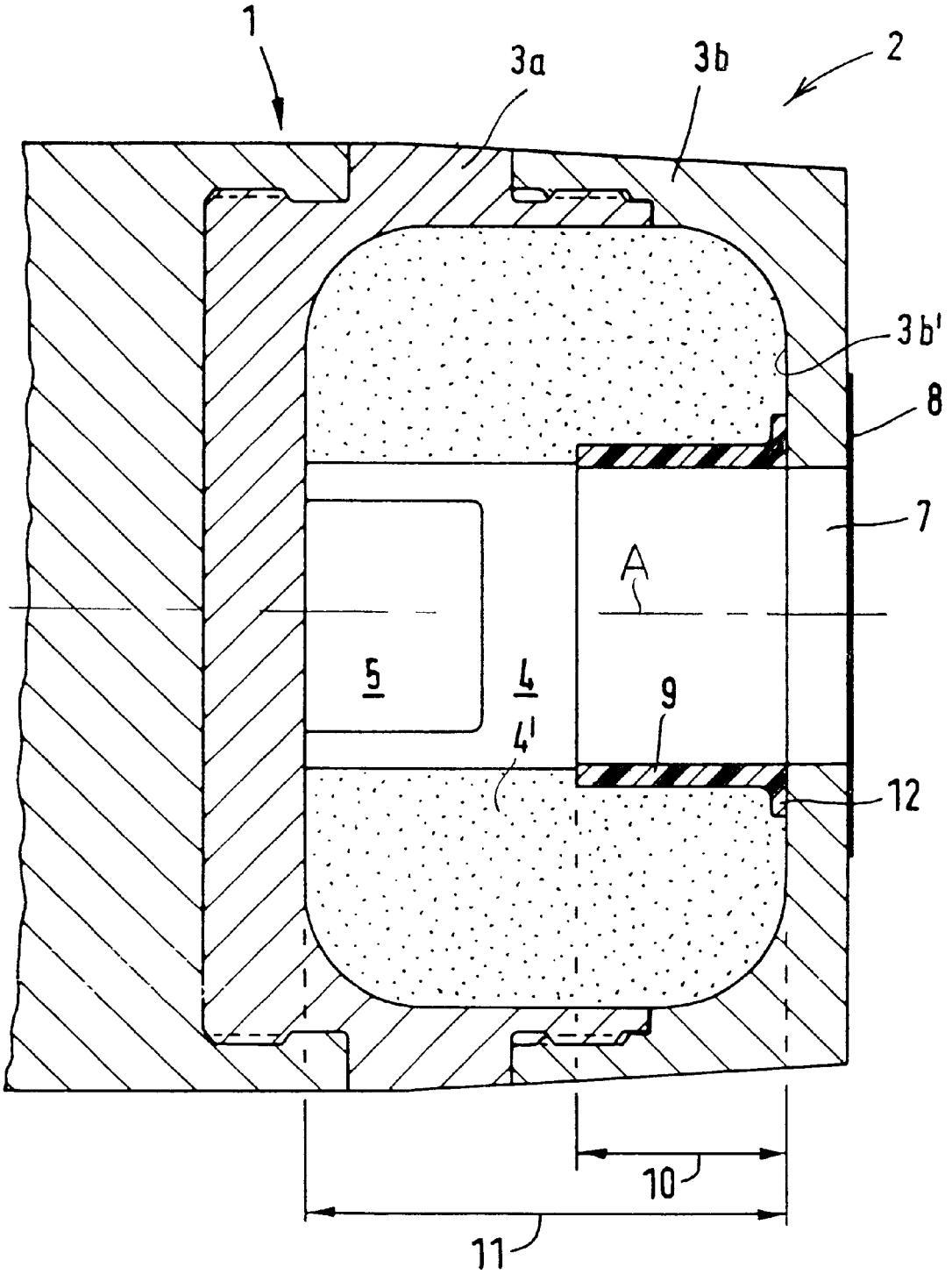
1
3a
3b
2
3b'
8
7
A
5
4
4'
9
12
10
11

GAS GENERATOR FOR A PROJECTILE

BACKGROUND OF THE INVENTION

This invention relates to a gas generator disposed in the rearward end portion of a projectile for increasing the range thereof.

Gas generators of the above-outlined type are known; they are of annular shape and are situated in a two-part housing and form an axially extending combustion chamber. The combustion chamber is adjoined in a rearward direction by a bottom exit passage extending through the housing. After ignition of the gas generator, the combustion gases flow out of the projectile through the bottom exit passage to thus reduce the otherwise prevailing base drag during the flight of the projectile.

Particularly in relatively long gas generators the problem is encountered that inertia forces axially compress the rearward region of the gas generator during the acceleration phase. The greatest compression occurs in the region of the bottom-side housing part. Such compression, because of an excessive stress, may cause fissures in the gas generator which result, among others, in a breakout of parts of the gas generator and because of such a surface increase, lead to a non-reproducible flight behavior of the projectile.

European Patent No. 0 285 184 (to which corresponds U.S. Pat. No. 4,846,071) discloses a gas generator in which a compression of the gas generator is prevented by providing, in the rearward region of the combustion chamber, a dome-shaped magnesium tube for supporting the propellant. The significant erosion of the magnesium caused by the combustion gases is to ensure that after a very short flight time the dome-shaped part of the supporting tube is consumed by the combustion gases of the generator to such an extent that the supporting tube does not affect the further flight behavior of the projectile.

It has been found in practice, however, that the supporting tube is frequently non-uniformly eroded by the combustion in the gas generator, thus adversely affecting a reproducible flight behavior of the projectile.

SUMMARY OF THE INVENTION

It is an object of the invention to provide an improved gas generator of the above-outlined type, having a supporting tube which, after ignition, has no adverse effect on the flight behavior of the projectile.

It is a further object of the invention to provide a projectile having a gas generator outfitted with such a supporting tube.

This object and others to become apparent as the specification progresses, are accomplished by the invention, according to which, briefly stated, the gas generator adapted to be disposed in a rear part of a projectile for increasing the flight range thereof, includes a housing defining a combustion chamber and having a bottom and a longitudinal axis; a fuel accommodated in the combustion chamber; an outlet opening provided in the housing bottom for passage of combustion gases generated in the combustion chamber upon combustion of the fuel; and a plastic fuel-supporting tube extending axially from the outlet opening into the combustion chamber. The plastic material of the fuel-supporting tube is selected such that upon combustion of the fuel aided by a gas pressure of a projectile propellant and by a drag effect, the fuel-supporting tube is deformed and driven out of the outlet opening. Such a material may be, for example, polypropylene.

Essentially, according to the basic principle of the invention, in that region of the combustion chamber which axially adjoins the bottom exit opening, a plastic supporting tube is provided, and the plastic material and the dimension of the supporting tube are selected in such a manner that the supporting tube is deformed by the gas stream generated immediately after the projectile leaves the weapon tube and by the still-prevailing high inner pressure generated by the projectile propellant in the combustion chamber, and under the simultaneous action of a suction effect, the supporting tube is driven through the bottom exit opening. As a result, the gas generator may subsequently continuously burn without being affected by the supporting tube.

To securely avoid a compression of the gas generator upon firing, it is has been found advantageous to design the length of the supporting tube such that it is between 40% and 50% of the axial length of the combustion chamber. Further, for an improved support of the plastic tube on the housing, the plastic supporting tube is provided with an outwardly projecting collar.

BRIEF DESCRIPTION OF THE DRAWING

The sole FIGURE is an axial sectional view of a rear portion of a projectile, incorporating a preferred embodiment of the invention.

DESCRIPTION OF THE PREFERRED EMBODIMENT

The FIGURE shows the rearward terminal portion of a projectile 1 having a longitudinal axis A. The rearward portion of the projectile 1 carries a gas generator generally designated at 2 and constructed according to the invention for reducing the base drag.

The gas generator 2 includes a two-part housing 3*a* and 3*b* which forms an axially extending combustion chamber 4 accommodating an annular gas-generating fuel 4' and an igniter 5. The combustion chamber 4 is adjoined in the rearward direction by an outlet opening 7 provided in the bottom 3*b*' of the housing part 3*b*. The outlet opening 7 is closed by a protective film 8.

A plastic cylindrical supporting tube 9 extends from the outlet opening 7 axially into the combustion chamber 4 for positioning therein the gas-generating fuel 4'. The axial length 10 of the supporting tube 9 is between 40% and 50% of the axial length 11 of the combustion chamber 4. Further, the supporting tube 9 has, for being better held on the housing bottom 3*b*', a radially outwardly extending collar 12.

After firing the projectile from the weapon tube, the igniter 5 ignites the fuel 4' of the gas generator 2. By means of the hot combustion gases of the gas generator 2 and the gas pressure of the projectile propellant prevailing in the combustion chamber 4, the supporting tube 9 is deformed under a simultaneous drag effect in such a manner that the gases propel the supporting tube 9 through the bottom outlet opening 7 out of the projectile 1, and thereafter the gas generator 2 may continue to burn to completion without being affected by the supporting tube 9.

It will be understood that the above description of the present invention is susceptible to various modifications, changes and adaptations, and the same are intended to be comprehended within the meaning and range of equivalents of the appended claims.

What is claimed is:

1. A gas generator adapted to be disposed in a rear part of a projectile for increasing the flight range thereof, comprising (a) a housing defining a combustion chamber and having a bottom and a longitudinal axis;

(b) a fuel accommodated in said combustion chamber;

(c) an outlet opening provided in said bottom for passage of combustion gases generated in said combustion chamber upon combustion of said fuel; and (d) a plastic fuel-supporting tube extending axially from said outlet opening into said combustion chamber; the plastic material of said fuel-supporting tube being selected such that upon combustion of the fuel aided by a gas pressure of a projectile propellant and by a drag effect said fuel-supporting tube is deformed and driven out of said outlet opening.

2. The gas generator as defined in claim 1, wherein said fuel-supporting plastic tube is cylindrical.

3. The gas generator as defined in claim 1, wherein an axial length of said fuel-supporting tube is between 40% and 50% of an axial length of said combustion chamber.

4. The gas generator as defined in claim 1, wherein said fuel-supporting tube has a radially outwardly extending collar engaging said bottom and surrounding said outlet opening.

5. A gas generator as defined in claim 1, wherein said plastic material is polypropylene.

6. The combination of a propellant pressure accelerated projectile having a longitudinal axis, a rearward part and a gas generator accommodated in said rearward part for increasing the flight range of said projectile; said gas generator comprising (a) a housing defining a combustion chamber and having a bottom and a longitudinal axis coinciding with said longitudinal axis of said projectile;

(b) a fuel accommodated in said combustion chamber;

(c) an outlet opening provided in said bottom for passage of combustion gases generated in said combustion chamber upon combustion of said fuel; and (d) a plastic fuel-supporting tube extending axially from said outlet opening into said combustion chamber; the plastic material of said fuel-supporting tube being selected such that upon combustion of the fuel aided by a gas pressure of a projectile propellant and by a drag effect said fuel-supporting tube is deformed and driven out of said outlet opening.

* * * * *